US006085435A

United States Patent [19]

Russi

[11] Patent Number: 6,085,435

[45] Date of Patent: Jul. 11, 2000

[54] HAIR DRYER ACCESSORY

[75] Inventor: Piero Russi, Milan, Italy

[73] Assignee: Trabo S.r.l., Milan, Italy

[21] Appl. No.: 09/315,760

[22] Filed: May 20, 1999

[30] Foreign Application Priority Data

Mar. 4, 1999 [IT] Italy ..... MI99A0443

[51] Int. Cl.[7] ..... A45D 20/12

[52] U.S. Cl. ..... 34/97; 132/271

[58] Field of Search ..... 34/96, 97, 98; 132/271; 392/379, 380, 383, 384, 385

[56] References Cited

U.S. PATENT DOCUMENTS

| | | | |
|---|---|---|---|
| 3,837,581 | 9/1974 | Orsoff | 239/289 |
| 3,860,174 | 1/1975 | Cercone | 239/135 |
| 4,019,260 | 4/1977 | Levy et al. | 34/97 |
| 4,538,362 | 9/1985 | Andis | 34/97 |
| 5,572,800 | 11/1996 | West | 34/97 |
| 5,649,370 | 7/1997 | Russo | 34/97 |
| 5,966,833 | 10/1999 | Andis et al. | 34/97 |

*Primary Examiner*—Pamela A. Wilson
*Attorney, Agent, or Firm*—Steinberg, Raskin & Liberchuk, P.C.

[57] ABSTRACT

A hair dryer accessory (8), to be mounted on a tubular part (4) of a hair dryer from which a continuous air flow emerges, the hair dryer accessory having a hollow body (10) adapted to be mounted on a portion (6) of the tubular part (4) of the hair dryer, the body (10) having an end portion (12) through which the air flow emerges. The end portion (12) is constructed from a flexible material enabling it to be manually folded back on the tubular part (4) of the hair dryer to enable the selective modification of the exit cross section of the end portion (12).

9 Claims, 2 Drawing Sheets

HAIR DRYER ACCESSORY

FIELD OF THE INVENTION

This invention relates to a hair dryer accessory, and in particular, a hair dryer accessory which is, at least in part, flexible.

BACKGROUND OF THE INVENTION

Various hair dryer accessories for connection to a tubular air exit part (or delivery part) of the hair dryer are known. Their purpose is to modify (in the sense of decreasing or increasing) the cross-section of the air exit from this delivery part in order to concentrate or spread the air flow onto or over a particular region of the user's hair.

Said accessories have various shapes, all approximately frustoconical. Depending on the position of the zone off reduced cross-section in relation to the delivery part to which they are connected, they either spread the air over a large hair region or concentrate it onto a small hair section, with consequent variation in the velocity with which the air strikes the hair. These accessories are therefore fitted to the delivery part only when in use. Hence when they are not needed they are removed from the hair dryer and are placed on a shelf or in a cupboard. There is therefore a high probability that they will be lost, or will fall off with consequent damage, or will suffer damage during their removal from or reconnection to the delivery part of the hair dryer.

OBJECTS AND SUMMARY OF THE INVENTION

An object of this invention is to provide a hair dryer accessory able to modify the passage cross-section for the air flow to the user which overcomes the aforesaid drawbacks of known accessories.

A particular object of the invention is to provide an accessory of the stated type which is easy to use, enables the hair dryer to be utilized to its full capability, and is safe in use.

A further object is to provide an accessory of the stated type which is of low cost.

A further object is to provide a hair dryer fitted with the stated accessory.

These and further objects which will be apparent to the expert of the art are attained by a hair dryer accessory in accordance with the accompanying claims.

BRIEF DESCRIPTION OF THE DRAWINGS

The invention will be more apparent from the accompanying drawing, which is provided by way of non-limiting example, and on which.

DETAILED DESCRIPTION OF THE PREFERRED EMBODIMENTS

Figure 1:
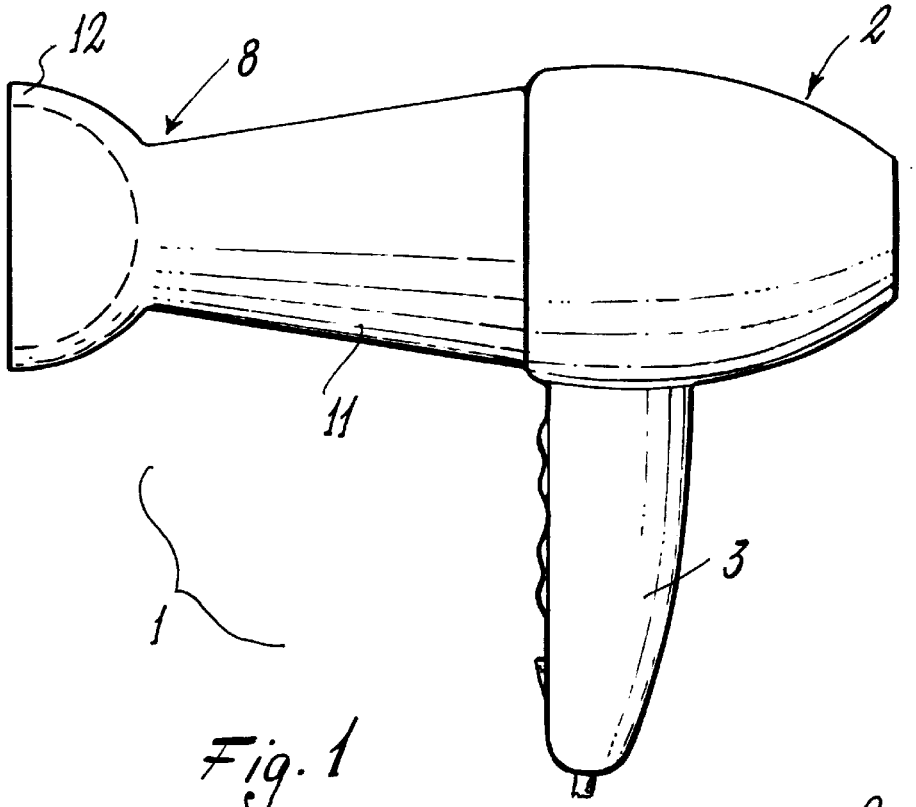
FIG. 1 is a side view of a hair dryer with the accessory of the invention, shown in a first utilization position.

With reference to said figures, a hair dryer is indicated overall by 1 and comprises a casing 2 with a handgrip 3 and a tubular or air delivery part 4. The hair dryer comprises known means, not shown, for generating said air flow.

On at least one portion, for example the end portion 6, of the delivery part 4 there is mounted an accessory 8 for modifying the passage cross-section for the air leaving said part 4 and directed towards a user (or for modifying the area of the user's hair struck by the air flow). By way of example, the accessory 8 can be on e which reduces said cross-section. Such an accessory (or "beak") has a hollow body 10 comprising a portion 11 to be mounted on the part 4 and a tapered end portion 12 through which the air flow leaves via a slit 13.

According to the invention, at least the end portion 12 is constructed of a flexible material able to withstand twisting and bending, and resistant to high temperature. For example, this material can be a silicone rubber or a synthetic rubber obtained from equivalent materials.

in this manner, if using the hair dryer 1 as shown in FIG. 1, the portion 12 of the accessory 8 widens out from the portion 11. The air exit cross-section is then defined by the slit 13. However if the cross-section needs to be increased, the portion 12 is folded back (arrow F of FIG. 1) onto the portion 11 until the opening 4A of the delivery part 4 of the hair dryer 1 is completely freed.

In a variant of the invention, the entire body 10 is constructed of flexible material just as its portion 12.

Figure 2:
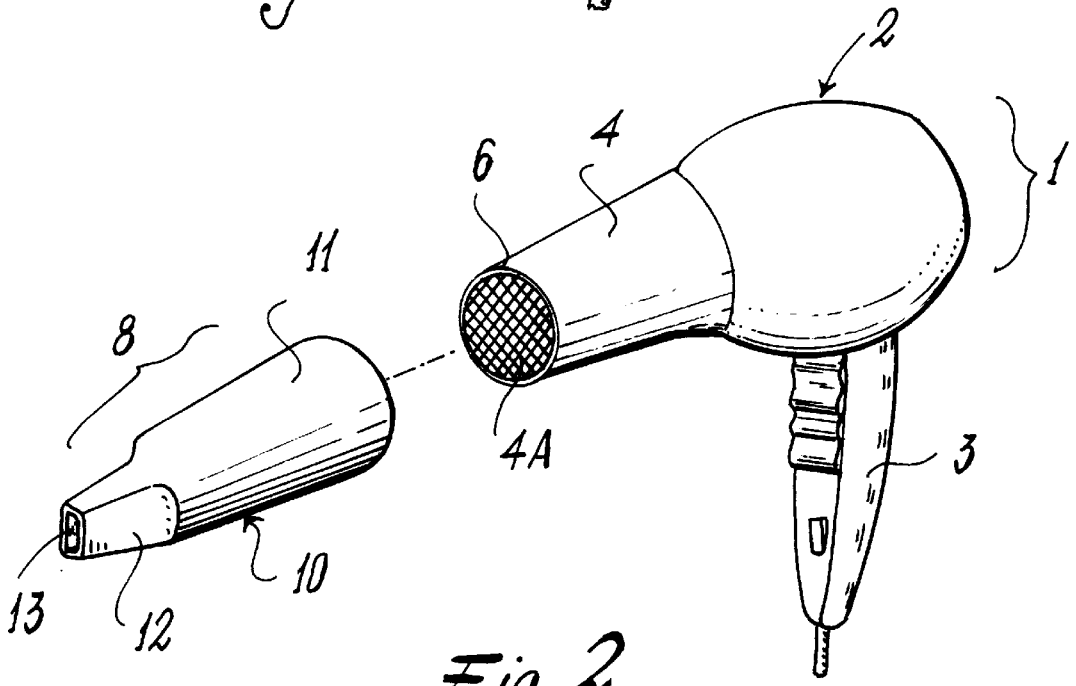
FIG. 2 is an exploded perspective view of the hair dryer of FIG. 1.
Figure 3:
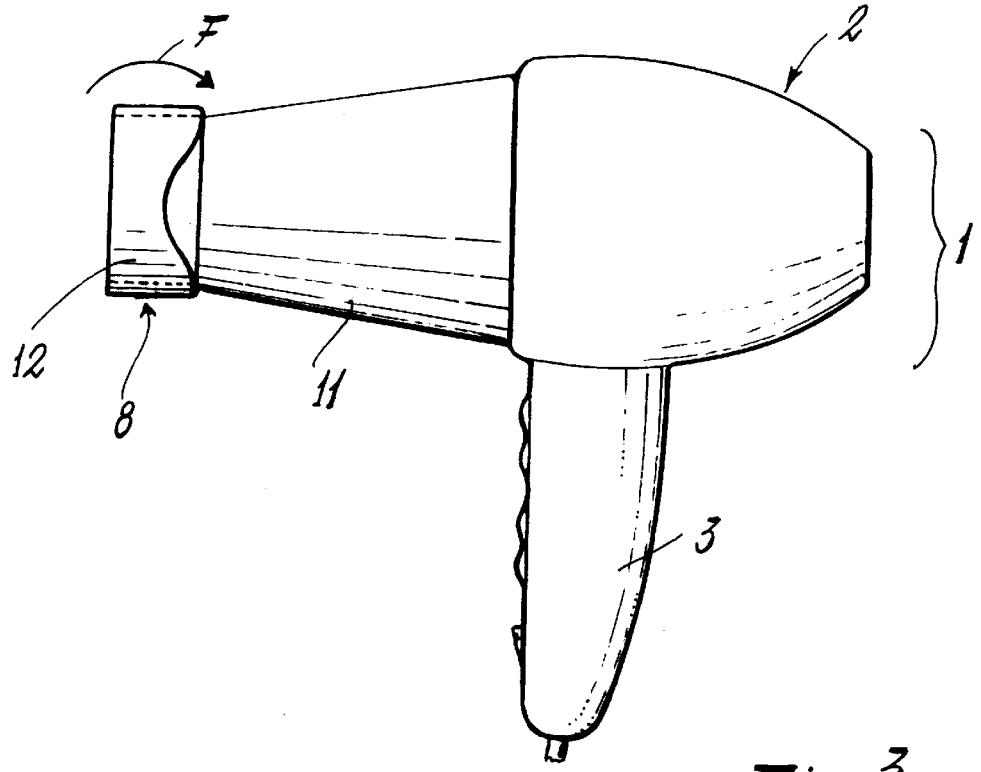
FIG. 3 is a view similar to FIG. 1, but with the accessory in a different utilization position.
Figure 4:
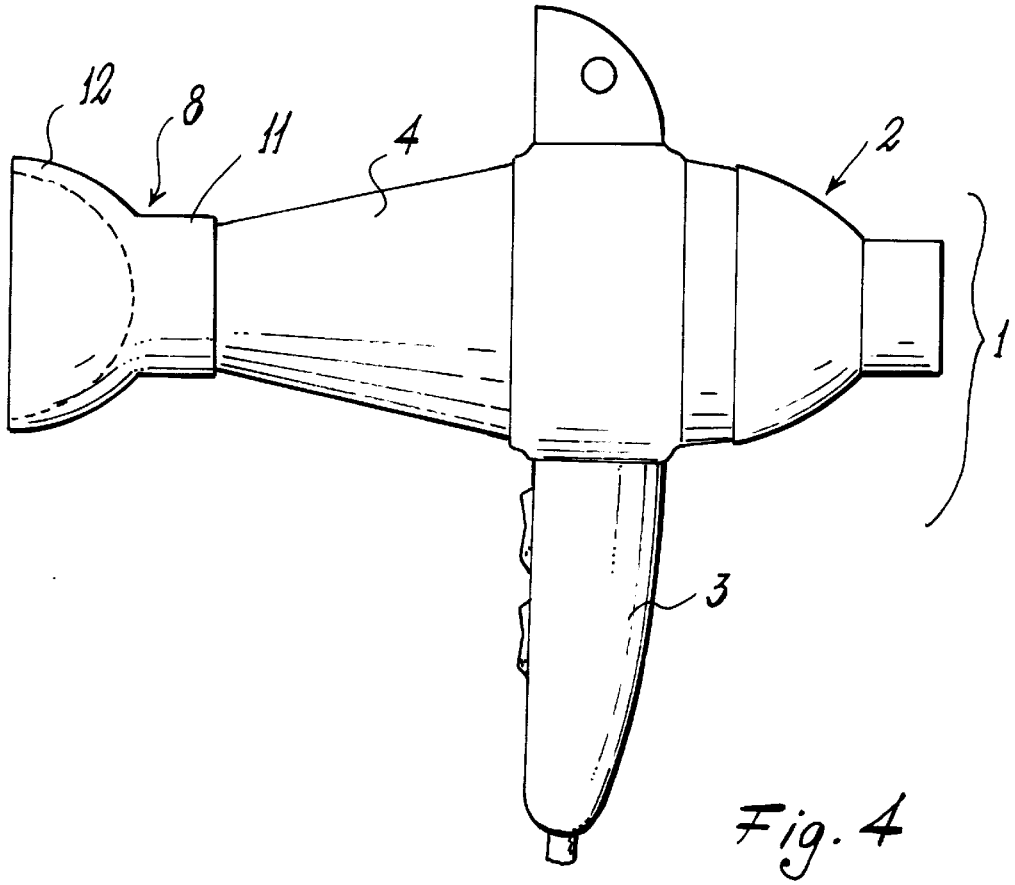
FIG. 4 is a side view of a different embodiment of the hair dryer of FIG. 1.

The body portion 11 (whether of flexible or non-flexible material) can be mounted over either the entire part 4 of the hair dryer 1 (as in FIGS. 1, 2 and 3) or only over its end portion 6 (as in FIG. 4).

In a further variant (not shown), the entire casing of the hair dryer is constructed of silicone rubber. In this case, usual stiffening elements provided in the handgrip 3 and along the casing enable the hair dryer to be correctly used.

By virtue of the invention, the hair dryer can be easily used with an accessory which can either reduce the air exit cross-section or maintain the cross-section of the delivery part 4, without ever having to remove the accessory 8 from the hair dryer.

An accessory 8 has been described which reduces the exit cross-section for the hair dryer air flow; however said accessory if suitably shaped (ie with the end portion 12 diverging) can also increase said cross-section, while still being able to be folded back onto the delivery part when required. This variant is also to be considered as falling within the scope of the present document.

What is claimed is:

1. A hair dryer accessory to be mounted on a tubular part (4) of the hair dryer from which a continuous air flow emerges, said accessory comprising a hollow body (10) to be mounted on at least a portion (6) of the tubular part (4) of the hair dryer, said body (10) having an end portion (12) through which the air flow emerges, wherein at least said end portion (12) is a flexible material for enabling said end portion (12) to be folded back toward the tubular part (4) of the hair dryer (1).

2. A hair dryer accessory as claimed in claim 1, wherein said end portion 12 is silicone rubber.

3. A hair dryer accessory as claimed in claim 1, said body (10) having a portion (11) for mounting on the delivery part (4) of the hair dryer, said portion (11) being a flexible material.

4. A hair dryer accessory as claimed in claim 1, wherein the end portion (12) tapers to reduce the air flow passage cross section, said flow passing through a slit (13) provided in said end portion (12).

5. A hair dryer accessory as claimed in claim 1, wherein the end portion (12) is of frusto-conical shape.

6. A hair dryer comprising a casing (2), a handgrip (3) and an air delivery part (4) on which an accessory in accordance with claim 1 is mounted.

7. A hair dryer as claimed in claim 6, wherein said casing (2) comprises a covering of silicone rubber.

8. A hair dryer as claimed in claim 6, wherein said casing (2) comprises a covering of synthetic rubber resistant to high temperature.

9. A hair dryer accessory as claimed in claim 1, wherein said end portion (12) is a rubber material resistant to high temperature.

* * * * *